US008616272B2

(12) United States Patent
Mazyar et al.

(10) Patent No.: US 8,616,272 B2
(45) Date of Patent: Dec. 31, 2013

(54) DOWNHOLE WATER-OIL SEPARATION ARRANGEMENT AND METHOD

(75) Inventors: Oleg A. Mazyar, Houston, TX (US); Michael H. Johnson, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 447 days.

(21) Appl. No.: 12/860,305

(22) Filed: Aug. 20, 2010

(65) Prior Publication Data

US 2012/0043072 A1 Feb. 23, 2012

(51) Int. Cl.
*E21B 43/34* (2006.01)

(52) U.S. Cl.
USPC ..... 166/105.5; 166/265; 210/323.1; 210/488

(58) Field of Classification Search
USPC ..... 166/265, 105.5; 210/799, 323.1, 488, 210/170.01, 170.07, 295
See application file for complete search history.

(56) References Cited

U.S. PATENT DOCUMENTS 3,223,240 A * 12/1965 Muller ..... 210/96.1
3,568,842 A * 3/1971 Bozek ..... 210/307
3,631,654 A * 1/1972 Riely et al. ..... 96/6
3,959,191 A 5/1976 Kehr et al.
4,237,237 A 12/1980 Jarre et al.
5,860,937 A * 1/1999 Cohen ..... 600/576
6,375,854 B2 * 4/2002 Beplate ..... 210/767
6,583,194 B2 * 6/2003 Sendijarevic ..... 521/172
6,747,068 B2 6/2004 Kelly
7,527,738 B2 * 5/2009 Gonzalez et al. ..... 210/690
7,823,635 B2 * 11/2010 Wright et al. ..... 166/105.5
7,854,261 B2 * 12/2010 Woie et al. ..... 166/265
8,262,909 B2 * 9/2012 Angelescu et al. ..... 210/321.75
2002/0189807 A1 * 12/2002 Emanuele et al. ..... 166/266

OTHER PUBLICATIONS

Matthews et al. "Application of Downhole Oil/Water Separation Systems in the Alliance Field," SPE Health, Safety and Environment in Oil and Gas Exploration and Production Conference, Jun. 9-12, 1996, New Orleans, Louisiana. [Abstract and Introduction Only].
Peachey, B.R. and C. M. Matthews. "Downhole Oil/Water Separator Development," Journal of Canadian Petroleum Technology, vol. 33, No. 7, Jul. 1994. [Abstract and Introduction Only].
Sartomer. "Product Bulletin: Hydroxyl Terminated Polybutadiene Resins and Derivatives—Poly bd® and Krasol®" Jun. 2007.
Veil et al. "Feasibility Evaluation of Downhole Oil/Water Separator (DOWS) Technology," U.S. Department of Energy, Office of Fossil Energy, National Petroleum Technology Office, 1998. [Summary Only].

* cited by examiner

*Primary Examiner* — Giovanna Wright
(74) *Attorney, Agent, or Firm* — Cantor Colburn LLP

(57) ABSTRACT

Disclosed herein is a downhole water-oil separation arrangement which includes a body having one or more portions thereof configured to have an affinity to a selected fluid. The body further will include one or more portions thereof that are configured to have an affinity to another fluid.

13 Claims, 1 Drawing Sheet

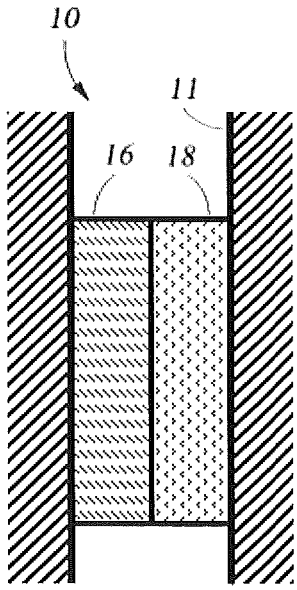
Fig. 2
(NEW)

DOWNHOLE WATER-OIL SEPARATION ARRANGEMENT AND METHOD

BACKGROUND

In the hydrocarbon recovery industry, target hydrocarbons are sought from reservoirs containing fluid stores that are partially composed of hydrocarbons and partially composed of water. For example, hydrocarbon reservoirs containing oil do not contain liquid oil alone but rather contain a mixture of oil and water. In some cases the water to oil ratio in formation fluids is 7:1. Production of fluids from such reservoirs then roughly requires the transport and all associated wear of 7 times the fluid that is actually desired. Since this also means that there are 7 units of undesired fluid produced, and which must then be disposed of, the cost benefit ratio is suspect.

Hydrocarbons are a fact of life for the foreseeable future and so methods and apparatus that improve efficiency in the process of recovery will be well received in the art.

SUMMARY

Disclosed herein is a downhole water-oil separation arrangement which includes a body having one or more portions thereof configured to have an affinity to a selected fluid and one or more portions thereof configured to have an affinity to another fluid.

BRIEF DESCRIPTION OF THE DRAWINGS

Referring now to the drawings wherein like elements are numbered alike in the several Figures:

FIG. 2 is a schematic cross-sectional view of an arrangement according to one embodiment disclosed herein with a body disposed with a container.

DETAILED DESCRIPTION

Figure 1:
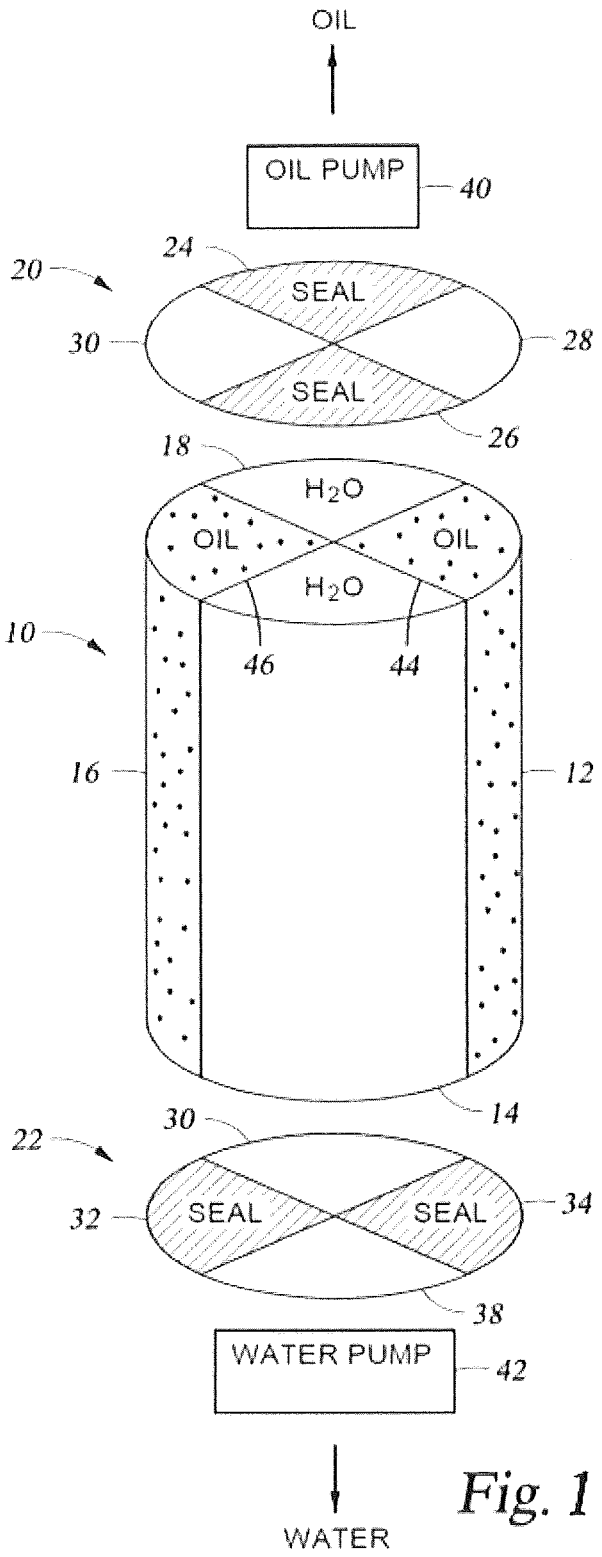
FIG. 1 is a schematic composite view of a number of embodiments of the arrangement disclosed herein.

Referring to the Figures, attention is first directed to a body 10. Body 10 is a schematically illustrated concept comprising a configuration that promotes oil migration in a distinct pathway from water migration through specific material of the body 10. In one embodiment the differential fluid migration is in two directions while in other embodiments the fluid migration may be in the same direction but with construction that conveys the distinct fluids to distinct pathways.

Considering a first exemplary embodiment, the body 10 is cylindrical as shown. It will be appreciated that any appropriate geometry is possible such as oval, square, rectangular, trapezoidal, etc. The geometry of the cross section of the body 10 is, in general, related to the cross section of a borehole in a formation in which the body is positioned or the cross section of a completion member and in which the body is positioned. This is especially true where the body comprises a shape memory material and therefore will conform to the shape of the "container" (e.g. open hole or completion) in which is it disposed. The body 10 is shown schematically within a container 11 in FIG. 2. In one embodiment, the material of the body is a polyurethane foam material that may have shape memory properties that can be harnessed in some embodiments to cause the body to contact and provide support to a formation wall.

Whether or not the material itself possesses shape memory characteristics, it will necessarily include portions having differential affinities. For example, one portion of the body 10 may have an affinity for a first fluid while another portion of the body 10 might have affinity for another fluid. In some embodiments one portion or portions will exhibit hydrophobicity while another portion or portions will exhibit hydrophilicty. In the illustrated embodiment the body 10 comprises portions 12, 14, 16 and 18 where portions 12 and 16 have an affinity to a particular fluid type, for example exhibit hydrophobic properties and portions 14 and 18 have an affinity for a different type of fluid, for example exhibit hydrophilic properties. It is to be understood that while the illustration contains 4 portions, more or fewer are contemplated. For example, there may be a single hydrophobic (or other type affinity) portion and one or more hydrophilic (or other type affinity) portions or a single hydrophilic (or other type affinity) portion and one or more hydrophobic (or other type affinity) portions. There also may be multiple portions of each type ranging from two to a number bounded only by practicality with respect to producing the body 10. Hydrophilic materials can be acquired commercially from many sources such as Rynel, Inc., Carwild Corp., Filtrona Porous Technologies, Foamex Innovations, etc. and Hydroxyl Terminated Polybutadiene, which is a polyol component of a hydrophobic polyurethane foam may be commercially acquired from such as Sartomer Company Inc., etc. Hydrophobic foam useful for the purposes disclosed herein, can be created from the Hydroxyl Terminated Polybutadiene by mixing the same with polyisocyanates and water (a foaming agent).

In one embodiment, and still referring to FIG. 1, a seal member 20 and a seal member 22 may each comprise a single member or a collection of pieces that form the member, or even may be separate pieces that are not connected to one another, is positioned at one or both ends of the body 10. The seal member 20 at either end is configured to prevent fluid migration from that end of body 10 for at least one of the fluids handled by body 10. Using FIG. 1 as an example, the seal 20 includes four quadrants, 24, 26, 28 and 30. 24 and 26 are aligned with the hydrophilic portions 14 and 18 of body 10 and hence are intended to prevent water from moving past. It will be appreciated that the portions 24 and 26 are at an uphole end of body 10 to prevent water from moving uphole. Quadrants 28 and 30 on the other hand are aligned with the hydrophobic portions 12 and 16 of the body 10 and are configured to allow fluid passage, i.e. these portions do not act as seals against the fluid collected in the hydrophobic portions of the body 10. As such, fluid such as oil that has been moved through the portions 12 and 16 of the body 10 is allowed to continue toward a target location such as uphole, and fluid such as water that has been moved through portions 14 and 18 is prevented from continuing uphole but rather is stopped in body 10. In one embodiment the seal 20 is used without a complementary seal 22 but in another embodiment both seals 20 and 22 are employed. Where both seals 20 and 22 are employed, the seal 22 will have an opposite orientation to that of seal 20. In the illustrated example, portions 32 and 34 are impermeable and are aligned with the hydrophobic portions 12 and 16 of body 10 to prevent the migration of fluid such as oil in a nondesired direction such as toward the bottom of a well, and portions 36 and 38 are permeable and aligned with portions 14 and 18 of body 10 to allow fluid such as water to continue to move in a direction that does not interfere with the purpose of the well. In the illustrated case this would be in a downhole direction. Each of these directed fluid movement configurations can be augmented with pumps 40 and 42 that will preferentially move whatever fluid they are fed in a particular direction. Because the fluid fed to the pumps will be the fluid that is desired to move in a particular direction and which has been segregated by the body 10, the goals of the arrangement are enhanced. In the illustrated embodiment, oil is segregated by body 10 and ferried in an uphole direction to pump 40 and water is segregated by the body 10 and ferried in a downhole direction to pump 42. The arrangement concentrated production of desirable fluids while avoiding the production of undesirable fluids thereby significantly improving efficiency and productivity.

It is further to be appreciated that in embodiments hereof, interportional surfaces 44 and 46 will be treated so that fluid is prevented from migrating across that interportional surface. Seals that are impermeable to polar and nonpolar fluids are contemplated such as rubber, nitrile, and other similar materials known to the downhole industry to be capable of providing impermeability.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A downhole water-oil separation arrangement comprising:

a body having one or more first portions thereof configured to have an affinity to a first fluid and one or more second portions thereof configured to have an affinity to a second fluid, wherein at least one of the first or second portions of the body comprises shape memory material, and the body includes structure that facilitates fluid movement in the one or more first portions in a first direction and in the one or more second portions in a second direction, the first and second directions being differing directions.

2. A downhole water-oil separation arrangement as claimed in claim 1 wherein the arrangement further includes a first seal member disposed at a first end of the body, the first seal member selectively sealing the one or more first portions at the first end while allowing flow from the one or more second portions at the first end.

3. A downhole water-oil separation arrangement as claimed in claim 2 wherein the arrangement further comprises a second seal member disposed at a second end of the body, the second seal member selectively sealing the one or more second portions at the second end while allowing flow from the one or more first portions at the second end.

4. A downhole water-oil separation arrangement as claimed in claim 3 wherein the second end is opposite to the first end and the second seal member seals the one or more first and second portions opposite to the first seal member.

5. A downhole water-oil separation arrangement as claimed in claim 1 wherein the arrangement further comprises a pump at a first end of the body to pump the first fluid.

6. A downhole water-oil separation arrangement as claimed in claim 5 wherein the arrangement further comprises a second pump disposed at a second end opposite to the first end of the body to pump the second fluid.

7. A downhole water-oil separation arrangement as claimed in claim 6 wherein the first and second pumps pump in opposite directions.

8. A downhole water-oil separation arrangement as claimed in claim 7 wherein the first pump pumps oil to a surface location and the second pump pumps water downhole and back into a formation.

9. A downhole water-oil separation arrangement comprising:

a downhole container being selected from the group consisting of a completion member in a borehole and an open hole borehole; and a body positioned within the downhole container and having one or more first portions thereof configured to have an affinity to a first fluid and one or more second portions thereof configured to have an affinity to a second fluid, wherein at least one of the portions includes fluid permeable foam in contact with the downhole container.

10. A downhole water-oil separation arrangement comprising:

a body having one or more first portions thereof configured to have an affinity to a first fluid and one or more second portions thereof configured to have an affinity to a second fluid;

a first seal member disposed at a first end of the body, the first seal member selectively sealing the one or more first portions at the first end while allowing flow from the one or more second portions at the first end; and a second seal member disposed at a second end of the body, the second seal member selectively sealing the one or more second portions at the second end while allowing flow from the one or more first portions at the second end.

11. A downhole water-oil separation arrangement as claimed in claim 1 further comprising a downhole container in which the body is positioned, wherein the shape memory material is operatively arranged to contact the downhole container with the body and conform in shape to the downhole container.

12. A downhole water-oil separation arrangement as claimed in claim 11 wherein the downhole container is an open hole borehole.

13. A downhole water-oil separation arrangement as claimed in claim 11 wherein the downhole container is a completion member in a borehole.

* * * * *